United States Patent [19]

Schmidt

[11] 3,954,652

[45] May 4, 1976

[54] BLEACHING AGENT

[75] Inventor: Oswald Schmidt, Frankenthal, Germany

[73] Assignee: BASF Aktiengesellschaft, Ludwigshafen (Rhine), Germany

[22] Filed: Aug. 29, 1973

[21] Appl. No.: 392,779

[30] Foreign Application Priority Data

Sept. 2, 1972 Germany ..... 2243330

[52] U.S. Cl. ..... 252/188; 8/110; 252/105

[51] Int. Cl.² ..... C11D 7/54; D06L 3/10

[58] Field of Search ..... 252/188, 105; 162/83, 162/82; 8/110; 423/519

[56] References Cited

UNITED STATES PATENTS

| | | | |
|---|---|---|---|
| 1,710,310 | 4/1929 | Helwig | 252/188 |
| 2,995,522 | 8/1961 | Joyce | 252/105 |
| 3,259,457 | 7/1966 | Sauls | 23/116 |
| 3,653,804 | 4/1972 | Janson | 8/110 |
| 3,773,679 | 11/1973 | Kise | 252/188 |

OTHER PUBLICATIONS

Pulp & Paper Magazine of Canada, Vol. 68, No. 6, June 1967, pp. T258–T267.

*Primary Examiner*—Samuel Feinberg
*Assistant Examiner*—Ralph Palo
*Attorney, Agent, or Firm*—Johnston, Keil, Thompson & Shurtleff

[57] ABSTRACT

Reductive bleaching agents which contain alkali metal sulfites and zinc oxide or soluble zinc salts.

10 Claims, No Drawings

BLEACHING AGENT

The present invention relates to bleaching agents based on reductive sulfur compounds containing zinc compounds as additives.

For decades reductive bleaching agents based on sulfur compounds containing sulfur in lower oxidation states, e.g. a dithionite or hydrosulfite, and optionally containing as additives zinc compounds, such as zinc sulfate, have been used for bleaching, particularly the bleaching of wool and later of nylon fibers. These bleaching agents are used in neutral media because the best bleaching effects have hitherto been obtained in this pH range. A bisulfite on the other hand is also useable in acid media, but has not hitherto proved to be particularly valuable when used alone as bleaching agent, because the bleaching effect is less with such a compound, i.e. the degree of whiteness obtained is too low.

On the other hand the more effective dithionite is only stable at higher pH values, because it rapidly decomposes into bisulfite and hydrogen sulfide as the pH is lowered. For this reason the normal reductive bleaching agents based on dithionite must be provided with buffering substances. Generally from two-thirds to three-fourths dithionite and one-third to one-fourth buffering substances are used. Phosphates and also organic complex-forming compounds, e.g. alkali metal salts of polyaminopolycarboxylic acids, can be used for example as buffering substances.

Before dithionite came into general use as a bleaching agent, bleaching was carried out in acidic liquors with sulfurous acid or with bisulfite or pyrosulfite. However, such a bleaching operation gave much poorer results than bleaching with dithionite.

The dithionites, although valuable as bleaching agents, have disadvantages so that further investigations must be made. Dithionites in bulk tend to undergo spontaneous decomposition in moist conditions. An attempt has been made to replace all or at least a small part of the alkali metal dithionite with zinc dithionite (German Patent 1,546,239). Zinc ions under these conditions have a stabilizing effect, i.e. they trap the hydrogen sulfide formed, but they have no other effect such as a catalyzing effect. The addition of zinc compounds enable the bleaching process to be carried out in the wealky acidic range (pH 4 to 7). It is a disadvantage however that the lower pH limit has to be strictly adhered to because otherwise the stabilizing properties of the zinc compounds are lost. However, in order to bleach wool it is necessary to bleach at a pH between 3.5 and 5, i.e. it should be possible to operate below the lower limit mentioned above without risk of harmful effects.

It is an object of the present invention to provide a bleaching agent which works well in strongly acidic media, has an adequate shelf life and is stable against decomposition during the bleaching process. Surprisingly, this object is achieved by means of a composition based on compounds of tetravalent sulfur.

We have found that a surprisingly good bleaching effect is obtained with a reductive bleaching agent based on sulfur compounds of the +4 oxidation state. These bleaching agents are characterized by a content of 60 to 95 wt.% alkali metal bisulfite and/or alkali metal pyrosulfite and 40 to 5 wt.% zinc oxide or soluble zinc salt, based on solid bleaching agent.

The bleaching is conveniently carried out at a pH from 3.5 to 5.5 but can also be carried out without risk below 3.5; it therefore takes place in acidic liquors. It will be appreciated that instead of soluble zinc salts zinc oxide can also be added, because this compound is likewise soluble under these pH conditions, so that the bleaching liquor contains a predetermined amount of zinc ions. The distinction over the said prior art processes (German Pat. 1,546,239) lies principally in that the latter explicitly requires insoluble zinc compounds to be present, i.e. the pH in the prior art process must be so high that zinc oxide, which is named in the said patent, is to be numbered amongst the insoluble compounds. Moreover the zinc compounds merely have a stabilizing effect there. The effect of the zinc in the bleaching agents according to the invention is now, surprisingly, to raise the degree of whiteness obtainable with sodium bisulfite up to a level which corresponds to the dithionite bleach. For example in the bleaching of wool reflectances are obtained which, when measured with a Zeiss Elrephro unit, filter R46T, could hitherto be obtained only with stabilized dithionite. A similar effect occurs with nylon.

The bleaching is preferably carried out at a pH of 4.5 to 5.5. The operating temperatures can vary from 60° to 90°C, but the bleaching process is preferably carried out at temperatures of 70° to 90°C. The bleaching time can vary from 20 minutes to more than one hour, but preferably is from 30 to 60 minutes, depending on temperature.

The bleaching agent of the invention consists of 60 to 95, preferably 65 to 90, wt.%, based on dry bleaching agent, of alkali metal bisulfite or preferably pyrosulfite, especially sodium pyrosulfite, and 40 to 5, preferably 35 to 10, wt.% zinc oxide or soluble zinc salt, for example zinc chloride or zinc sulfate. Generally there are 2 to 10 moles of bisulfite (i.e. 1 to 5 moles of pyrosulfite) per mole of zinc compound, preferably 3 to 8 moles of bisulfite (i.e. 1.5 to 4 moles of pyrosulfite) per mole of zinc compound. The considerable excess of bisulfite or pyrosulfite also means that the mixtures are very favorably priced and considerably cheaper than the mixtures containing stabilized dithionite required hitherto.

Furthermore, in the bleaching agents of the invention a part of the bisulfite or pyrosulfite can be replaced by dithionite or salts of hydroxymethanesulfinic acid. Sodium and zinc hydroxymethanesulfinates are typical of such compounds. Outstanding bleaching effects, which considerably surpass the ones which were obtainable hitherto with stabilized dithionite, can be achieved in this way.

These amounts are, in general, less than 50 wt.%, based on the bleaching agent. Preferably 15 to 35 wt.%, based on the total bleaching composition, is used and the preferred pH conditions are then chosen, i.e. those in the range from 4.5 to 5.5.

It is in principle not important what acid, whether inorganic or organic, is used to set up the pH required. Sulfuric acid, hydrochloric acid and phosphoric acid as well as formic acid, acetic acid, adipic acid, succinic acid, glutaric acid, furmaric acid, maleic acid, lactic acid, oxalic acid, tartaric acid, citric acid and other carboxylic acids are examples of acids which can be used.

The bleaching agent is to be understood as a combination which basically is a synergistic composition. On the one hand it is known to obtain good bleaching effects with dithionite and small quantities of zinc compounds, and on the other hand it is known to obtain some bleaching effect with alkali metal bisulfites. However it was not known that the conjoint use of zinc compounds and bisulfite or the preferred mixture of bisulfite and minor amounts of dithionite or hydroxymethanesulfinate and zinc compounds would lead to such an improvement in the results. It is the surprising technical advance afforded by this synergistic mixture that constitutes the invention. Hitherto, zinc compounds have had a stabilizing effect but not an activating one.

Wool and nylon fibers can be particularly successfully bleached with the agents of the invention. It is however also possible in principle to bleach cellulosic fibers (e.g. cotton) or regenerated cellulose, sensitive animal fibers such as silk and furs, leather, and also paper and pulp.

In the bleaching operation liquor ratios in the range from 5:1 to 60:1 are generally chosen but if desired longer or shorter liquors can be used.

The results obtained with wool and nylon are summarized in the following two Tables, in which prior art bleaching agents have been included in order to show up the technical advance afforded by the process of the invention.

Similar white effects are usually obtained when bleaching is carried out not on raw material but on a material which has been subjected to a preliminary oxidative bleach with hydrogen peroxide.

In Tables 1 and 2 the effect of the new bleaching agents on wool (Examples 1 to 7a) and polyamide 6,6 (Examples 8 to 12) is shown. Bleaching was carried out in conventional manner using a liquor ratio of 40:1 with a bleaching time of one hour.

The bleaching technique is well known in the art.

TABLE 1

Woolen piece goods (Reflectance = 56.1%.) prepurified.

| Ex. No. | Bleaching agent type | conc g/l | pH | Temp °C | Reflectance % |
|---|---|---|---|---|---|
| 1. | sodium pyrosulfite | 3 | 4.0 | 85 | 60.1 |
| 2. | sodium dithionite(90%) | 2.3 | 7.0 | 70 | 65.4 |
| | + sodium pyrophosphate | 0.7 | | | |
| 3. | sodium pyrosulfite | 2.7 | 4.0 | 85 | 63.8 |
| | + zinc oxide | 0.3 | | | |
| 4. | sodium pyrosulfite | 2.4 | 4.0 | 85 | 64.2 |
| | zinc oxide | 0.6 | | | |
| 5. | sodium pyrosulfite | 2.0 | 4.5 | 85 | 67.6 |
| | zinc oxide | 0.3 | | | |
| | sodium dithionite(90%) | 0.7 | | | |
| 5a. | as 5 | | 5.0 | 85 | 68.2 |
| 6. | sodium pyrosulfite | 2.28 | 4.5 | 85 | 68.8 |
| | zinc oxide | 0.12 | | | |
| | zinc hydroxymethane-sulfinate | 0.6 | | | |
| 6a. | as 6 | | 5.0 | 85 | 68.3 |
| 7. | sodium pyrosulfite | 2.28 | 4.5 | 85 | 67.6 |
| | zinc oxide | 0.27 | | | |
| | sodium hydroxymethane-sulfinate | 0.48 | | | |
| 7a. | as 7 | | 5.0 | 85 | 67.3 |

TABLE 2

Knitted goods of nylon 6.6 (Reflectance = 82.4%), prepurified.

| Ex. No. | Bleaching agent type | conc g/l | pH | Temp °C | Reflectance % |
|---|---|---|---|---|---|
| 8. | sodium dithionite(90%) | 2.3 | 7.0 | 70 | 85.1 |
| | sodium pyrophosphate | 0.7 | | | |
| 9. | sodium pyrosulfite | 2.0 | 4.5 | 85 | 86.4 |
| | zinc oxide | 0.3 | | | |
| | sodium dithionite(90%) | 0.7 | | | |
| 10. | as 9 | | 5.0 | 85 | 86.5 |
| 11. | sodium pyrosulfite | 2.28 | 4.5 | 85 | 87.1 |
| | zinc oxide | 0.12 | | | |
| | zinc hydroxymethane-sulfinate | 0.6 | | | |
| 12. | as 11 | | 5.0 | 85 | 87.1 |

We claim:

1. A reductive bleaching agent comprising a mixture of a. 60 to 95% by weight of a sulfur compound in the +4 oxidation state selected from the group consisting of alkali metal bisulfites and pyrosulfite; and b. 40 to 5% by weight of a zinc compound selected from the group consisting of zinc oxide and soluble zinc salts, the percentages being with reference to the total weight of the dry bleaching agent.

2. A reductive bleaching agent as claimed in claim 1, wherein a part of the alkali metal bisulfite and/or pyrosulfite is replaced by a bleaching compound selected from the group consisting of alkali metal dithionites and alkali metal zinc salts of hydroxymethanesulfinic acid.

3. A reductive bleaching agent as claimed in claim 1, which contains from 15 to 35% by weight with reference to the dry bleaching agent, of a bleaching compound selected from the group consisting of alkali metal dithionites and alkali metal and zinc hydroxymethanesulfinates.

4. A strongly acidic aqueous bleaching liquor containing, as a reductive bleaching agent, a mixture consisting essentially of a. 60 to 95% by weight of a sulfur compound in the +4 oxidation state selected from the group consisting of alkali metal bisulfites and pyrosulfite; and b. 40 to 5% by weight of a zinc compound selected from the group consisting of zinc oxide and soluble zinc salts, the percentages being with reference to the total weight of the dry bleaching agent.

5. A reductive bleaching agent as claimed in claim 1 having a proportion of 65 to 90% by weight of (a) to 35 to 10% by weight of (b).

6. The bleaching liquor as claimed in claim 4 having a pH of less than about 5.5.

7. The bleaching liquor as claimed in claim 6 having a proportion of 65 to 90% by weight of (a) to 35 to 10% by weight of (b).

8. The bleaching liquor as claimed in claim 4 having a pH of about 3.5 to 5.

9. The bleaching liquor as claimed in claim 8 having a proportion of 65 to 90% by weight of (a) to 35 to 10% by weight of (b).

10. The bleaching liquor as claimed in claim 9 wherein a part of the alkali metal bisulfite and/or pyrosulfite is replaced by a bleaching compound selected from the group consisting of alkali metal dithionites and alkali metal zinc salts of hydroxymethanesulfinic acid.

* * * * *